US011129464B2

(12) United States Patent
Berhault et al.

(10) Patent No.: US 11,129,464 B2
(45) Date of Patent: Sep. 28, 2021

(54) WIPER FOR CONTAINER OF COSMETIC PRODUCT

(71) Applicant: L'OREAL, Paris (FR)

(72) Inventors: Alain Berhault, Clichy (FR); Eric Caulier, Clichy (FR); Lionel Drugeon, Clichy (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 16/611,766

(22) PCT Filed: May 2, 2018

(86) PCT No.: PCT/EP2018/061191
§ 371 (c)(1),
(2) Date: Nov. 7, 2019

(87) PCT Pub. No.: WO2018/206364
PCT Pub. Date: Nov. 15, 2018

(65) Prior Publication Data

US 2021/0145150 A1 May 20, 2021

(30) Foreign Application Priority Data

May 10, 2017 (FR) ..... 1754109

(51) Int. Cl.
*A45D 40/26* (2006.01)
*A45D 34/04* (2006.01)

(52) U.S. Cl.
CPC ..... *A45D 40/267* (2013.01); *A45D 34/046* (2013.01); *A45D 2200/10* (2013.01)

(58) Field of Classification Search
CPC .. A45D 34/042; A45D 34/043; A45D 34/045; A45D 34/046; A45D 34/047; A45D 34/048; A45D 40/262; A45D 40/40; A45D 40/264; A45D 40/265; A45D 40/267;
(Continued)

(56) References Cited

U.S. PATENT DOCUMENTS 7,967,519 B2 * 6/2011 Gueret ..... A45D 40/267 401/122
8,403,580 B2 * 3/2013 De Laforcade ..... A45D 40/267 401/129
2005/0092345 A1 5/2005 Lim
(Continued)

FOREIGN PATENT DOCUMENTS

DE 91 10 895 U1 6/1992
EP 1 481 607 A1 12/2004
(Continued)

OTHER PUBLICATIONS

International Search Report dated Jun. 20, 2018 in PCT/EP2018/061191 filed on May 2, 2018.

*Primary Examiner* — David J Walczak
(74) *Attorney, Agent, or Firm* — Oblon, McClelland, Maier & Neustadt, L.L.P.

(57) ABSTRACT

A wiper for a container of cosmetic product, the wiper including a substantially tubular body including at least one wiping portion of which a free interior surface defines a wiping passage through which an application member can pass in a wiping direction, the wiping portion is made of a thermoplastic elastomer having a hardness less than 70 Shore 00, preferably less than 45 or 50 Shore 00.

15 Claims, 3 Drawing Sheets

(58) Field of Classification Search
CPC ..... A45D 40/268; A45D 2200/10; A45D 2200/1009; A45D 2200/1018
USPC ..... 401/121–130
See application file for complete search history.

(56) References Cited

U.S. PATENT DOCUMENTS

| | | | | |
|---|---|---|---|---|
| 2009/0065019 | A1* | 3/2009 | Salciarini ..... | A45D 40/267 132/218 |
| 2012/0294665 | A1 | 11/2012 | Gueret | |
| 2017/0088314 | A1 | 3/2017 | Jacob et al. | |

FOREIGN PATENT DOCUMENTS

| | | | |
|---|---|---|---|
| EP | 1 529 462 | A2 | 5/2005 |
| FR | 2 918 255 | A1 | 1/2009 |
| FR | 2 951 621 | A1 | 4/2011 |
| WO | WO 2017/053026 | A1 | 3/2017 |

* cited by examiner

WIPER FOR CONTAINER OF COSMETIC PRODUCT

This application is a United States national stage application of International Application No. PCT/EP2018/061191, filed May 2, 2018, which designates the United States, and claims priority to French Patent Application No. 1754109, filed May 10, 2017, and the entire contents of each of the above applications are hereby incorporated herein by reference in entirety.

The present invention relates to a wiper for an assembly for packaging and applying a cosmetic product.

The expression "cosmetic products" is understood to mean any product as defined in Regulation (EC) No 1223/2009 of the European Parliament and Council of Nov. 30, 2009 relating to cosmetic products.

The packaging and application assembly according to the present application is more particularly intended for the application of a cosmetic product, such as a makeup or care product, to a keratinous substance and/or keratin fibers, and notably for the application of mascara to the eyelashes.

The packaging and application assembly according to the present application may also relate to a fluid product for the lips, such as a lip gloss or tint. The packaging assembly according to the present application is also applicable to other fluid products such as eyeshadow, concealer or foundation in liquid form.

The term "keratin materials" preferably means human keratin materials, notably keratinous appendages, and more particularly keratin fibers.

The term "keratin fibers" in particular means the eyelashes and/or the eyebrows, and preferably the eyelashes. For the purposes of the present application, this term "keratin fibers" also extends to synthetic false eyelashes.

Mascara is understood to be a composition intended to be applied to the eyelashes. It may notably be a makeup composition for the eyelashes, a makeup base for the eyelashes, (or "base coat"), a composition to be applied over mascara, (or "top coat"), or else a composition for the cosmetic treatment of the eyelashes.

The mascara is more particularly intended for human eyelashes, but also for false eyelashes.

The application of mascara is in particular directed toward increasing the intensity of the gaze, notably by increasing the volume of the eyelashes to a greater or lesser extent.

In general, the application of the cosmetic product involves depositing the desired quantity of material on the intended keratinous surface in order to obtain the desired effect. The cosmetic product is applied by means of an applicator.

Numerous cosmetic product applicators that are intended for applying said product to keratin fibers, in particular mascara to eyelashes, are known.

In addition to the particular composition of the cosmetic product, the applicator plays an important role in the quality of application of the cosmetic product and in the quantity of product deposited.

In general, an applicator comprises an applicator member defining an application surface. The applicator member has a main body or core, of generally elongate shape, said main body being able to bear application elements that project from said core.

The applicator member, particularly in the case of applicators for the lips, may be completely or partially flocked. The fibers of the flocking assist in product retention and thus form application elements.

Preferably, the application elements extend in an overall direction substantially normal to the core (particularly a radial direction).

During application, the application member is loaded with cosmetic product and brought into contact with the fibers in order to deposit the product on said fibers. The application elements, which are spaced apart, form cosmetic product reservoir zones.

The application member is mounted at the end of a stem, generally made of plastic, secured to a member for grasping.

The applicator is generally intended to be used with a reservoir which contains the cosmetic product to be applied and a free edge of which delimits an opening. The applicator member is introduced through the opening into the reservoir, where it is loaded with cosmetic product before being withdrawn from said reservoir in order to carry out the application.

Thus, the applicator is movable between a first position, known as the pick-up position, in which the applicator member is situated inside the reservoir and is able to be brought at least partially into contact with the cosmetic product contained in the reservoir, and a position, known as the application position, in which the applicator member can be brought into contact with a part of the human body.

This mode of use is conventionally known by the name of "dip-in" because the application member needs to be dipped into the reserve of cosmetic product in order to load it with product prior to application.

The reservoir is generally equipped with a closure member designed to close the opening of said reservoir in a removable manner.

In the conventional way, the opening is situated at one end of a neck of the reservoir, said neck having an external screw thread able to engage with a corresponding internal tapped thread belonging to the closure member, typically a screw-on cap.

According to a customary mode of packaging, the closure member also constitutes the member for grasping the applicator, the application member thus being arranged inside the reservoir when it is not in use.

In order to remove excess cosmetic product and adjust the load on the application member, the opening of the reservoir is generally equipped with a wiping member referred to as a wiper.

A wiper has a roughly tubular hollow structure through which the application member can pass at least when this member is being extracted from the reservoir.

The wiper comprises at least one wiping portion configured to come into contact with at least the application member as it is being extracted. Advantageously, the wiping portion is configured to also be able to come into contact with the stem on which the application member is mounted.

The wiping portion is elastically deformable so as to allow the wiper to adapt to variations in section between the stem and the application member and within the application member itself.

Thus, the wiping portion is generally made from a thermoplastic elastomer (for example a nitrile rubber).

Thermoplastic elastomers, or TPEs, is generally intended to mean polymers or a blend of polymers that have, at the service temperature, properties similar to those of vulcanized rubber. These properties disappear at the processing temperature, making subsequent processing possible, but reappear when the material returns to the service temperature (cf. standard ISO 18064:2014). For general information on thermoplastic elastomer materials, reference may in particular be made to the guide from *Techniques de*

*l'Ingénieur, Traité Plastiques et Composites* [*Engineering Techniques, Treatise on Plastics and Composites* ], *AM* 3 400 by Michel Biron published on 10 Jul. 2000.

The thermoplastic material used may be, for example, SEBS (styrene-ethylene/butylene-styrene), a silicone, butyl rubber, EPDM (Ethylene Propylene Diene Monomer), a nitrile rubber, a polyester elastomer, a polyamide elastomer, a polyethylene elastomer or a vinyl elastomer, but also a polyolefin such as polyethylene (PE) or polypropylene (PP).

In addition to the wiping portion intended to come directly into contact with the application member, a wiper may comprise a mounting portion intended for assembling it on the reservoir.

The wiping portion has a free interior edge defining a wiping or scraping orifice for wiping or scraping the application member and optionally the stem.

The wiping portion is generally configured so that the section of the wiping orifice at rest, namely in the absence of deformation caused by the passage of the application member and/or of the stem of the applicator, is less than the maximum cross section of the application member.

For preference, the cross section of the wiping orifice is substantially equal to, or even slightly smaller than, the cross section of the stem of the applicator.

Numerous wiper configurations have already been proposed with a view to improving the wiping of the application member while at the same time being suited to the shape thereof and to that of the stem.

It is thus advantageous to propose a wiping member which allows uniform wiping, without this wiping being too vigorous, as that would have the effect of making the application of makeup more difficult.

Examples of wipers are described notably in documents U.S. Pat. Nos. 4,390,298, 4,617,948, FR2504788 (serrated wiper), EP1561394 and EP0829211.

A first type of wiper, which is the most widespread, comprises a wiping portion defined by a lip which is elastically deformable, essentially in bending, projecting out from the tubular mounting portion.

The wiping lip has a free interior edge defining the wiping or scraping orifice for wiping or scraping the application member and the stem.

In order to be able to deform easily, the lip has a thickness that is relatively small and very small in comparison with the diameter of the wiping orifice, for example of between 0.4 mm and 1 mm, inclusive.

During the extraction and/or the insertion of the application member through the wiping orifice, the wiping lip deforms both significantly in bending in a longitudinal direction corresponding to the direction of extraction or of insertion of the application member and in a radial direction that allows it to adapt to the cross section of the application member at the moment of passing through said lip.

More specifically, the wiping lip is stretched both longitudinally and radially.

Such a type of wiper is commonly referred to as a "lip-type wiper".

In order to ensure optimal wiping, the elastomeric material used to create the wiping lip needs not to be too soft and it is known that wiping lips with too low a Shore hardness lose their wiping effectiveness, thus making the application of makeup difficult.

Conversely, in order not to eliminate too much product and to maintain good ease of deformation, the hardness of the material needs not to be too high.

Conventionally, the elastomeric material used thus has a hardness of between 20 Shore A and 70 Shore A.

Furthermore, during extraction of the applicator, the wiping lip sometimes needs to bend over. That leads to initial resistance to extraction of the applicator, reducing user comfort and ease of extraction.

Wipers of which the wiping portion is made from a block of cellular material, notably a foam, particularly an open-cell foam, have also been proposed. Such a wiper is described notably in document WO9731553A1.

The block of foam is split or hollowed axially to allow the passage of the application element when the latter is withdrawn from the container in order to be used.

For preference, the foam chosen is soft enough to allow the applicator to be returned without the user having to pay particular attention or having to bring the application member into a given orientation.

U.S. Pat. No. 6,446,637 mentions the possibility of replacing the block of foam with a block of elastomeric material. However, that document gives no information as to the features or nature of such a material.

There is a need to further perfect the wiping members and in particular to have a wiping member capable of satisfactorily wiping the application member while at the same time improving the sensation perceived by the user at the time of withdrawing the applicator.

The present invention seeks to achieve these objectives and to this end proposes a wiper for a container of cosmetic product, said wiper comprising a substantially tubular body comprising at least one wiping portion of which a free interior surface defines a wiping passage through which an application member can pass in a wiping direction, said wiper being characterized in that the wiping portion is made of a thermoplastic elastomer having a hardness less than 70 Shore 00, preferably less than 45-50 Shore 00.

The thermoplastic material may be a single thermoplastic elastomer or a mixture of thermoplastic elastomers the mix of which possesses the target hardness property.

Thus, by using a material that has a relatively low hardness in comparison with the materials conventionally used for producing wiping lips, it has been found that it was possible to obtain more accurate and finer wiping of the application member, the greater deformability of the wiping portion allowing it to better conform to the contours of the application member. The wiping is more uniform and more consistent overall, without being excessively vigorous For preference, the thermoplastic elastomer has a hardness less than 30 Shore 00, preferably less than 20 Shore 00.

By using a material that has a relatively low hardness in comparison with the conventional materials, it has been found that it was possible to obtain very accurate and very fine wiping of the application member, the very great deformability of the wiping portion allowing it to conform perfectly to the contours of the application member.

According to one preferred embodiment, the wiping portion, in the absence of deformation caused notably by the passage of the application member, has a tubular, preferably cylindrical, shape, the wiping orifice having a preferably circular cross section.

For preference, the length of the wiping passage, in the direction of wiping, is greater than or equal to a diameter of the wiping passage.

For preference also, the thickness of the wiping portion, in a direction perpendicular to the direction of wiping and over at least most of the length of the wiping passage, is greater than or equal to half the diameter of the wiping passage, preferably greater than the diameter of the wiping passage.

The use of a block wiper, which means to say one comprising a relatively tall and thick wiping portion, limits the flexural deformation of said wiping portion and encourages deformation in compression in a direction substantially transverse to the direction of insertion and extraction of the applicator (direction of wiping).

This then results in more even wiping and in an absence of a "hard point" felt by the user upon extraction (because there is no folding back of the lip).

Moreover, the use of a TPE material, which is nonporous, makes it possible to avoid the phenomenon whereby the foam becomes engorged with the cosmetic product, something which, over time, may adversely affect its properties, and which also carries a greater risk of bacterial growth.

The use of a TPE material also limits the risks of permanent deformation of a foam during the course of its use with the applicator moving back and forth.

Advantageously, the wiping passage has a frustoconically shaped application member insertion orifice and/or application member extraction orifice. That assists with centering the application member as it is being extracted/inserted. This feature also allows a more progressive scraping at the entrance/exit of the wiping passage.

According to a first alternative form of embodiment, the wiper comprises a catching portion, said catching portion preferably being produced as one piece with the wiping portion, notably by molding or injection molding, or from a different material, preferably another thermoplastic elastomer, for example by two-shot injection molding.

According to a second alternative form of embodiment, the wiper has no catching portion.

Advantageously, the wiping portion comprises an external surface having an at least partially peripheral, preferably completely peripheral, bulge, the bulge preferably having a rectangular profile section.

The presence of a peripheral bulge allows the wiping portion to be held in position, maintaining a space between it and where appropriate, a lateral wall, against which the wiper may be arranged, said lateral wall then acting as a compression end stop as the application member passes through said wiping portion. The presence of a clearance to the lateral wall allows modification of the nature of the response of the material of the wiping portion, and notably the force with which it scrapes, as the application member passes. More specifically, in instances in which the wiping portion comes into abutment against a lateral wall, the wiping portion will have a natural tendency to work in compression because said wiping portion will be blocked against said wall as the application member passes. By contrast, in the event of a space left between the wiping portion and a potential lateral wall (or the absence of a lateral end stop), said wiping portion will rather have a tendency to work in elongation. Working in elongation then allows reliance to be placed essentially on the intrinsic elasticity and firmness qualities of the material.

Advantageously, the external bulge is situated at one end, preferably a bottom end, of the wiping portion when considered in the direction of wiping.

The directions are given with respect to the orientation of the wiper as fitted in the packaging and application device. Thus top and bottom directions are to be understood as meaning, respectively, intended to be oriented toward a product distribution opening and intended to be oriented toward a bottom of the reservoir situated at the opposite end to the distribution opening.

Advantageously, the wiping portion comprises at least one additional passage that forms a vent, configured to allow a communication of air between a first interior space of a reservoir situated on one side of the wiping portion and a second space situated on an opposite side of the wiping portion.

The presence of a vent in the wiping portion makes it possible to avoid any phenomenon of overpressure or of depression as the application member is introduced or extracted through said wiping portion. Specifically, the great deformability of the elastomer material used leads to greater intimacy between the material and the application member and to increased sealing as the application member passes.

The occurrence of overpressure or depression may lead to a suction noise or the like which is not very attractive to the user.

The present invention also relates to a device for packaging and applying a product, notably a cosmetic product, comprising a body that forms a reservoir intended to contain the cosmetic product to be applied and a free edge of which delimits an opening able to allow at least the extraction of an application member from inside the reservoir, the opening being equipped with a wiper according to the invention.

For preference, the opening is situated at the end of a neck, the wiper preferably being arranged at least partially inside the neck, notably via a catching portion able to collaborate with retaining means complementing said catching portion.

Advantageously, the wiping portion is situated after the neck inside the reservoir, said wiping portion preferably having an upper surface that comes into contact with an internal surface of a shoulder of the neck.

According to one preferred embodiment, the wiper has no catching portion and is arranged in a wiper holder having at least one perforated lower wall, the wiping portion preferably being spaced away, over a majority of the length of the wiping passage, from a lateral wall of the wiper holder or of the reservoir.

Advantageously and to complement this, a retention zone for the wiping portion, formed notably by the shoulder of the neck and/or the lower surface of the wiper holder, may be adapted according to the flexural deformation desired as the application member passes.

Specifically, in the case of a retention zone extending substantially over the entire thickness of the wiping portion, the latter will be blocked in terms of bending as the application member passes. It is possible to reduce the length of this retention zone in such a way as to permit greater or lesser amounts of flexural deformation.

The present invention will be better understood in light of the following detailed description with reference to the appended drawing in which.

Unless specified otherwise, the wiper configurations are given at rest, namely in the absence of deformation caused by the passage of the application member during an extraction and/or insertion movement.

Moreover, the directions are given with respect to the orientation of the wiper as fitted in the packaging and application device. Thus, top and bottom directions are to be understood as meaning, respectively, intended to be oriented toward a product distribution opening and intended to be oriented toward a bottom of the reservoir situated at the opposite end to the pickup/distribution opening.

Figure 1:
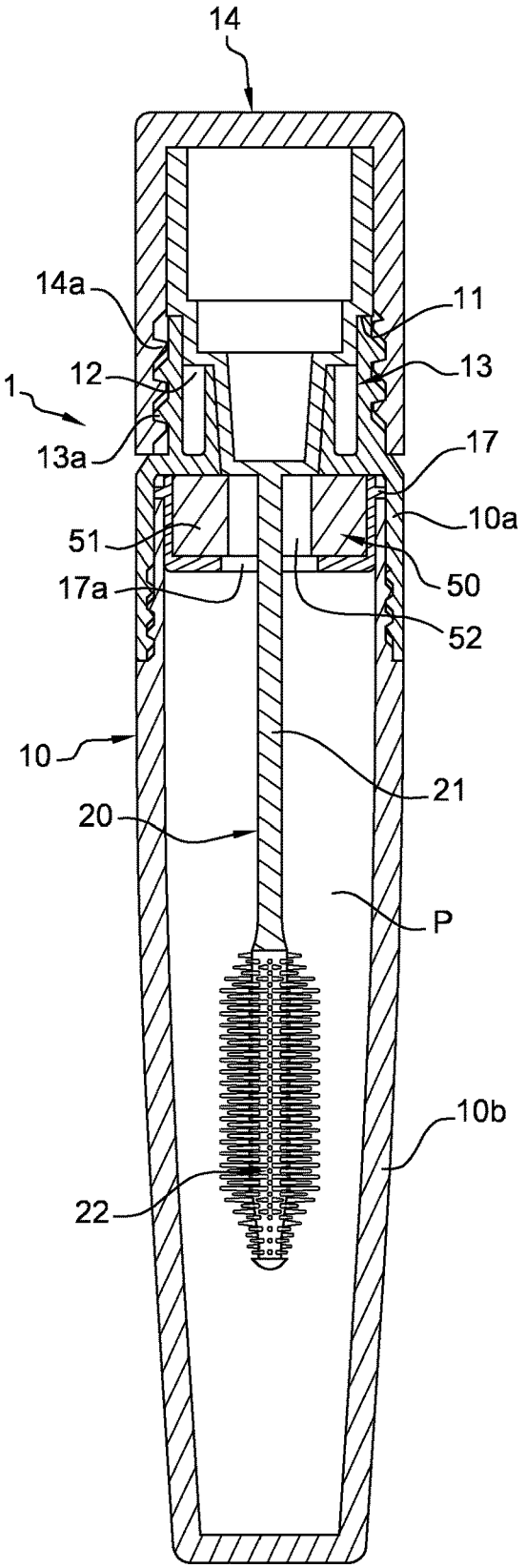
FIG. 1 is a schematic depiction, in longitudinal cross section, of a first packaging and application assembly equipped with a wiper according to the invention not provided with a catching portion.

FIG. 1 shows a packaging and application assembly 1 comprising a body forming a reservoir 10 which is intended to contain the cosmetic product P to be applied and a free edge 11 of which delimits an opening 12. More specifically, the opening 12 is situated at one end of a neck 13 of the reservoir 10.

As will be described below, for assembly purposes, the neck 13 is produced in the form of a band 10*a* attached to a main part 10*b* of the reservoir 10, notably by snap-fastening, clip-fastening or screw-fastening.

The reservoir 10 is equipped with a detachable closure member 14 designed to close the opening 12 of said reservoir 10 in a removable manner. In this case, the closure member 14 is in the form of a cap that is able to engage with the neck 13, notably by screw-fastening.

According to the embodiment depicted, the cap 14 can be screwed on and for this purpose comprises an internal screw thread 14*a* able to engage with an external screw thread belonging to the neck 13*a*. Quite obviously, other ways of closure may be envisioned, for example a closure of magnetic type.

The packaging and application assembly 1 comprises an applicator 20 having a stem 21 that has a first end connected to the closure member 14 and a second end connected to an application member 22.

The closure member 14 forms a member for grasping the applicator 20.

The application member 22 comprises an elongate main body bearing a set of protruding application elements. The application elements between them define a plurality of spaces for loading and applying the cosmetic product P.

In this particular instance, the application member 22 is a mascara applicator.

Although illustrated by an application member 22 made from a molded thermoplastic elastomer, the present application is clearly not restricted thereto and the application member 22 may, particularly for mascara, be an application member of the "fibers" type or "twisted core" type formed by the helical winding or twisting together of two branches of a metal wire forming a core around tufts of bristles extending radially out from the metal wire. The application member 22 may also be a hybrid or compound application member.

Furthermore, the application member 22 is not restricted to a mascara applicator and may be any applicator suited to the cosmetic product contained in the reservoir.

By way of the closure member 14, the applicator 20 is able to move between a first position, known as the pick-up position, in which said applicator member 22 is situated inside the reservoir 10 and is able to be brought at least partially into contact with the cosmetic product P, and a second position, known as the application position, in which the applicator member 22 can be brought into contact with a part of the human body to which makeup is to be applied.

According to the present application, the reservoir 10 is equipped with a wiping member 50 that is disposed close to the opening 12 and is able to wipe at least the applicator member 22 of the applicator 20 as said applicator 20 is withdrawn.

According to the embodiment, the wiper 50 is disposed inside the reservoir 10 at an entry of the neck 13.

The wiper 50 comprises a substantially tubular body comprising at least one wiping portion 51 of which a free internal surface defines a wiping passage 52 through which the application member 22 is able to pass in a wiping direction.

The wiping direction corresponds substantially to a longitudinal direction of the neck 13 and of the reservoir 10.

More particularly, the wiper 50 has no catching portion and comprises only the wiping portion 51 which takes the form of a block of thermoplastic elastomer.

According to the present application, the thermoplastic elastomer has a hardness less than 70 Shore 00, preferably less than 45-50 Shore 00.

In this particular instance, the thermoplastic elastomer has a hardness less than 30 Shore 00, preferably less than 20 Shore 00.

The thermoplastic elastomer is a TPS or TPES, preferably a SEBS. The thermoplastic material used may also belong to the TPE gel family, making it possible to obtain a very low hardness.

As indicated previously, the thermoplastic material may be a single thermoplastic elastomer or a mixture of thermoplastic elastomers the mix of which possesses the target hardness property.

By way of example of materials that can be used, mention may be made of the PolyOne® materials marketed under the references GLS 454-115 (18 Shore 00) and GLS 458-083 (20 Shore A).

Advantageously, the material used may be a blend representing, for example, 70/30 by weight or 50/50 by weight, depending on the materials used, of thermoplastic elastomers having different degrees of hardness. The use of a blend in order to obtain the desired hardness can notably make it possible to reduce the total cost of the material by using a high proportion of a harder but less expensive material or vice-versa.

By virtue of the use of a thermoplastic elastomer, the wiper can be produced simply using an injection molding method and makes it possible to avoid any later cutting step, unlike the use of a block of foam.

To all intents and purposes it is also possible to add to the TPE material fillers exhibiting certain specific functionalities and, for example, a bactericidal function (a filler of zinc, active charcoal, silver or copper for example).

The wiper 50 has a wiping portion 51 of cylindrical shape.

The wiping passage 52 has a length in the wiping direction that is greater than or equal to a diameter of the wiping passage 52.

Thus, the length of the wiping passage 52 may conventionally be around 5 to 6 mm.

As indicated hereinabove, the diameter of the wiping passage 52 is determined so that it is smaller than the maximum diameter of the application member 22.

For preference, the diameter of the wiping passage 52 is smaller than the minimum diameter of the application member 22, so that it is able to wipe the entirety of the application member 22.

Thus, the diameter of the wiping passage 52 may conventionally be less than 5 mm.

For preference also, the diameter of the wiping passage 52 is substantially equal to or even slightly smaller than the diameter of the stem 21, so as to be able also to wipe the stem 21 as the applicator is being extracted.

Such a feature makes it possible to achieve effective sealing at the stem 21 between said stem 21 and the wiping portion. Advantageously, efforts will be made to ensure that the clamping, which means to say the difference between the diameter of the wiping passage and the diameter of the stem 21 is at least 0.1 mm, preferably at least 0.2 mm.

Thus the diameter of the wiping passage 52 may conventionally be less than or equal to 2 mm.

The thickness of the wiping portion 51, in a direction perpendicular to the direction of wiping, is greater than or equal to half the diameter of the wiping passage 52, in this particular instance around 0.75 times the diameter of the wiping passage 52.

Thus, the thickness of the wiping portion may conventionally be between 2 and 6 mm.

The wiper 50 is arranged inside the reservoir 10 at the base of the neck 13 in a wiper holder 17 in the form of a basket caught on a rim of the reservoir 10 before the band 10*a* that forms the neck 13 is put in place.

The wiper holder 17 has a central orifice 17*a* that coincides with the wiping passage 52 so as to allow the application member 22 to pass through.

As explained above, the dimension of the orifice may be adjusted according to the desired retention of the wiping portion and, in particular, the desired flexural deformation as the application member passes.

Thus, the wiping portion 51 is comprised between a lower shoulder of the neck 13 and the wiper holder 17, an upper surface of said wiping portion 51 coming into contact with an internal surface of a shoulder of the neck.

In general, the retaining zone for the wiping portion 51, here by way of the shoulder of the neck 13 and the lower surface of the wiper holder 17, may be adapted according to the flexural deformation desired as the application member passes.

Specifically, in the case of a retention zone extending substantially over the entire thickness of the wiping portion, the latter will be blocked in terms of bending as the application member passes. It is possible to reduce the length of this retention zone in such a way as to permit greater or lesser amounts of flexural deformation.

Figure 2:
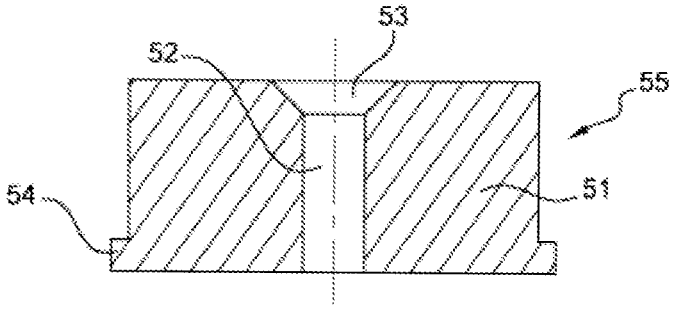
FIG. 2 is a schematic depiction, in longitudinal cross section, of an alternative form of embodiment of the wiper of FIG. 1.

FIG. 2 depicts an alternative form 55 of the wiper 50 comprising, independently of one another, a wiping passage 52 exhibiting an upper insertion orifice 53 of frustoconical cross section and a peripheral bulge 54 situated at a lower end of the wiping portion.

Optionally, the lower orifice may also have a frustoconical cross section.

The presence of a peripheral bulge 54 allows, when the wiper 50 is in place in the wiper holder 17, it to be correctly positioned in said wiper holder 17 while at the same time keeping the wiping portion 51 spaced away from a lateral wall of the wiper holder 17 or of the reservoir 10, as appropriate.

The presence of such a clearance to a lateral wall makes it possible to improve the initial deformation of the wiping portion 51 as the application member 22 passes before said wiping portion is compressed against the lateral wall of the wiper holder 17 or of the reservoir which supports it.

According to one embodiment, the height of the peripheral bulge 54 is less than or equal to 20% of the height of the wiping portion. Thus, in the case of a wiper of a height of 6 mm, the height of the peripheral bulge 54 may be around 1 mm.

The thickness of the peripheral bulge 54 will be dependent on the desired delay on compression and the desired elongation work. For example, the thickness of the peripheral bulge may be less than or equal to 20% of the thickness of the wiping portion 51, (excluding the thickness of the bulge 54). For preference, the thickness of the peripheral bulge will be less than 15%. Thus, for a wiping portion having a thickness of around 5 mm, the thickness of the peripheral bulge will be around 0.5 mm.

Figure 3:
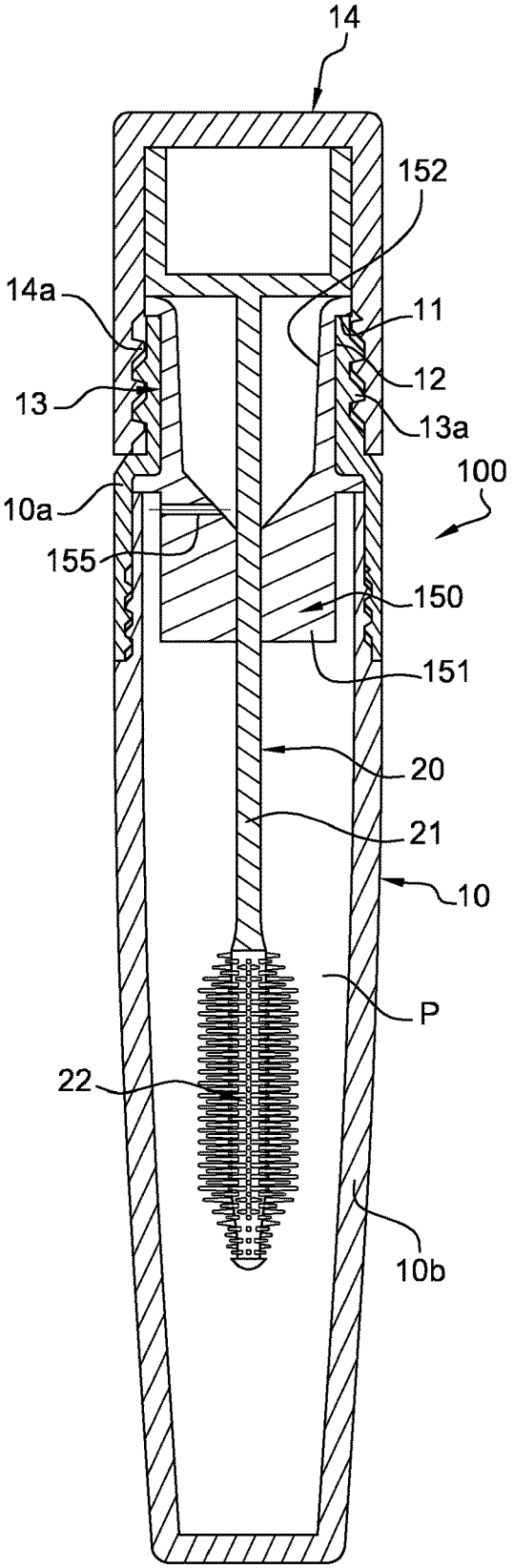
FIG. 3 is a schematic depiction, in longitudinal cross section, of a second packaging and application assembly equipped with a wiper according to the invention having a catching portion.

FIG. 3 shows a packaging and distribution assembly 100 differing from the assembly 1 essentially in that it is equipped with a wiper 150 which, in addition to a wiping portion 151 as described earlier, has a catching portion 152.

Thus, the wiper 150 is not held in a wiper holder 17 but is attached directly to the neck 13 via its catching portion 152.

The catching portion 152 is produced as one piece with the wiping portion 151.

The catching portion 152 may be produced after the manner of the catching portions of conventional lip-type wipers.

The catching portion 152 may be made from the same material as the wiping portion or preferably from a more rigid thermoplastic elastomer (conventionally having a hardness in excess of 20 Shore A), making it easier to catch and retain. The use of a different material can be achieved by a two-shot injection molding or an overmolding method.

In addition it will be noted that the wiping portion 151 also comprises an additional passage that forms a vent 155, configured to permit a communication of air between a first interior space of a reservoir situated on one side of the wiping portion and a second space situated on an opposite side of the wiping portion. The vent 155 extends substantially in a direction transverse to the wiping axis, notably a radial direction.

The presence of the vent 155 makes it possible to avoid any phenomenon of overpressure or of depression (piston effect) as the application member 22 is introduced or extracted through said wiping portion 152.

Figure 4:
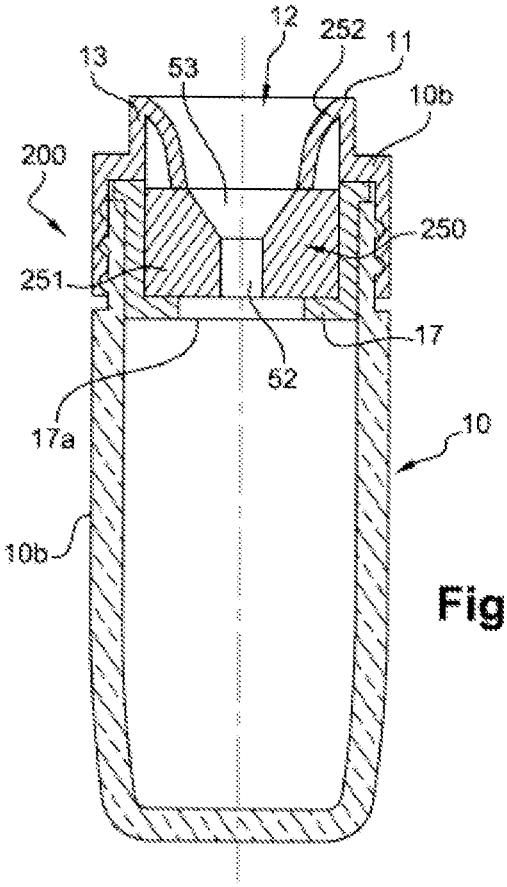
FIGS. 4 and 5 illustrate alternative forms of embodiment of a wiper according to the invention.

FIG. 4 shows a packaging and distribution assembly 200 differing from the assembly 1 essentially in that it is equipped with a wiper 250 which has a wiping portion 251 and a catching portion 252.

The wiping portion 251 is similar to the wiping portion 51 except that it comprises a frustoconical upper orifice 53 similar to that of the wiper 55.

Moreover, the wiping portion 251 is also supported in a wiper holder 17.

The catching portion 252 is produced as one piece with the band 10*b* that forms the neck 13.

Thus, the wiper 150 is not held in a wiper holder 17 but is attached directly to the neck 13 via its catching portion 152.

For preference, the wiping portion is made from a material that has enough rigidity to ensure that the assembly is held firmly on the reservoir 10. The wiper 250 may notably be produced using a two-shot injection molding or an overmolding method. Where appropriate, it will be advantageous to provide zones in relief making it possible to increase the mechanical attachment between the materials (cf., for example, EP 2 574 252).

Depending on the rigidity of the material used to make the catching portion, it is also conceivable to overmold it on the neck 13.

Figure 5:
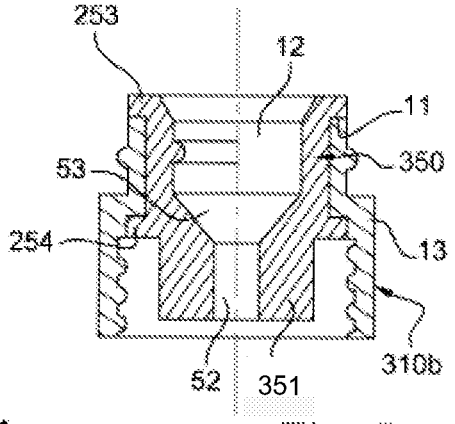

FIG. 5 shows a band 310*b* forming a neck 13 and intended to be attached to a corresponding main part of a reservoir of a packaging and distribution assembly.

The neck 13 is equipped with a wiper 350 according to the present application comprising a wiping portion 351 similar to the wiping portion 251, and a catching portion 252 configured to collaborate with the neck 13 and hold the wiper 350 in place.

In order to do this, the wiping portion 252 has a upper peripheral radial rim 253 and a lower peripheral radial rim 254, the rims 253 and 204 coming into engagement respectively with the free edge 11 of the neck 13 and with an internal lower shoulder of that same neck 13.

As before, depending on the hardness of the material used, it is possible to overmold the catching portion on the neck 13, the neck then providing the mechanical integrity.

Figure 6:
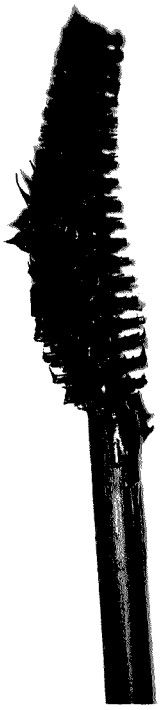
FIGS. 6 and 7 are photos of a wiper obtained with a block wiper made respectively from a foam with a hardness of 20 Shore A and from a thermoplastic elastomer with a hardness of 17 Shore 00.
Figure 7:
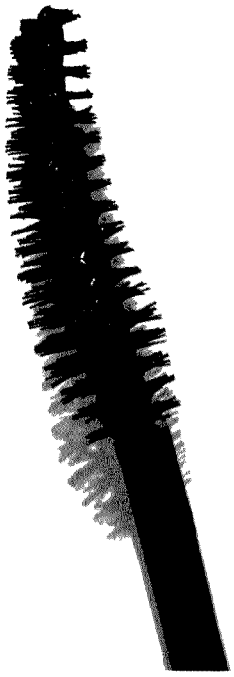

FIGS. 6 and 7 are photos showing the result of wiping performed by a foam block wiper according to the prior art (FIG. 6) and using a block wiper comprising of wiping portion produced from a TPE with a hardness of 18 Shore 00.

The difference in wiping precision is clearly visible.

The invention claimed is:

1. A wiper for a container of cosmetic product, said wiper comprising a substantially tubular body comprising at least one wiping portion of which a free interior surface defines a wiping passage through which an application member can pass in a wiping direction, wherein the wiping portion is made of a thermoplastic elastomer having a hardness less than 50 Shore 00.

2. The wiper as claimed in claim 1, wherein the thermoplastic elastomer has a hardness less than 30 Shore 00.

3. The wiper as claimed in claim 1, wherein the wiping portion, in the absence of deformation caused by the passage of the application member, has a tubular shape, the wiping passage having a circular cross section.

4. The wiper as claimed in claim 3, wherein a length of the wiping passage, in the direction of wiping, is greater than or equal to a diameter of the wiping passage.

5. The wiper as claimed in claim 3, wherein a thickness of the wiping portion, in a direction perpendicular to the direction of wiping and over at least most of a length of the wiping passage, is greater than or equal to half a diameter of the wiping passage.

6. The wiper as claimed in claim 1, wherein the wiping passage has at least one of a frustoconically shaped application member insertion orifice and an extraction orifice for the application member.

7. The wiper as claimed in claim 1, wherein the wiper comprises a catching portion said catching portion being produced as one piece with the wiping portion, by molding or injection molding, or from a different material by two-shot injection molding.

8. The wiper as claimed in claim 1, wherein the wiper has no catching portion.

9. The wiper as claimed in claim 1, wherein the wiping portion comprises an external surface having an at least partially peripheral bulge.

10. The wiper as claimed in claim 9, wherein the bulge is situated at one end of the wiping portion when considered in the direction of wiping.

11. The wiper as claimed in claim 1, wherein the wiping portion comprises at least one additional passage that forms a vent, configured to allow a communication of air between an interior first space of a reservoir situated on one side of the wiping portion and a second space situated on an opposite side of the wiping portion.

12. A device for packaging and applying a a cosmetic product comprising a body that forms a reservoir intended to contain the cosmetic product to be applied and a free edge of which delimits an opening able to allow at least the extraction of an application member from inside the reservoir, the opening being equipped with a wiper as claimed in claim 1.

13. The device as claimed in claim 12, wherein the opening is situated at an end of a neck, the wiper being arranged at least partially inside the neck, and, via a catching portion, able to collaborate with retaining means complementing said catching portion.

14. The device as claimed in claim 12, wherein the wiping portion is situated after the neck inside the reservoir, said wiping portion having an upper surface that comes into contact with an internal surface of a shoulder of the neck.

15. The device as claimed in claim 12, wherein the wiper has no catching portion and is arranged in a wiper holder having at least one perforated lower wall, the wiping portion being spaced away, over a majority of a length of the wiping passage, from a lateral wall of the wiper holder or of the reservoir.

* * * * *